US011926912B2

(12) United States Patent
Zimmerman et al.

(10) Patent No.: US 11,926,912 B2
(45) Date of Patent: Mar. 12, 2024

(54) ELECTRODE ASSEMBLY FOR ELECTROCHEMICAL PROCESSES

(71) Applicant: PERMASCAND AKTIEBOLAG, Ljungaverk (SE)

(72) Inventors: Erik Zimmerman, Frösön (SE); Christian Almroth, Sundsvall (SE); John Gustavsson, Ljungaverk (SE); Per Magnus Sjödell, Torpshammar (SE)

(73) Assignee: PERMASCAND AKTIEBOLAG, Ljungaverk (SE)

( * ) Notice: Subject to any disclaimer, the term of this patent is extended or adjusted under 35 U.S.C. 154(b) by 66 days.

(21) Appl. No.: 17/616,472

(22) PCT Filed: Jun. 3, 2020

(86) PCT No.: PCT/EP2020/065324
§ 371 (c)(1),
(2) Date: Dec. 3, 2021

(87) PCT Pub. No.: WO2020/245179
PCT Pub. Date: Dec. 10, 2020

(65) Prior Publication Data

US 2022/0325426 A1 Oct. 13, 2022

(30) Foreign Application Priority Data

Jun. 3, 2019 (EP) ..... 19177908

(51) Int. Cl.
*C25B 9/00* (2021.01)
*C25B 1/26* (2006.01)
(Continued)

(52) U.S. Cl.
CPC ..... *C25B 9/65* (2021.01); *C25B 1/26* (2013.01); *C25B 9/17* (2021.01); *C25B 9/63* (2021.01); *C25C 1/00* (2013.01); *C25C 7/02* (2013.01)

(58) Field of Classification Search
CPC .... C25B 9/65; C25B 9/63; C25B 9/17; C25B 1/26; C25C 1/00; C25C 7/02
See application file for complete search history.

(56) References Cited

U.S. PATENT DOCUMENTS

2008/0277280 A1* 11/2008 Riebel ..... G01N 33/48785 204/406
2012/0205239 A1 8/2012 Gonzalez Olguin
2014/0262761 A1 9/2014 Labra Vargas

FOREIGN PATENT DOCUMENTS

WO 201202043 A1 2/2012
WO 2014047689 A1 4/2014
WO 2017064485 A1 4/2017

OTHER PUBLICATIONS

International Search Report from International Application No. PCT/EP2020/065324 dated Aug. 4, 2020.

* cited by examiner

*Primary Examiner* — Zulmariam Mendez
(74) *Attorney, Agent, or Firm* — Shih IP Law Group, PLLC

(57) ABSTRACT

The invention is related to an electrode assembly for an electrochemical process comprising a current supply device, an elongated current distribution bar comprising first and second ends, and a sheet-shaped electrode substrate attached to the current distribution bar and having a longitudinal extension and a lateral extension. The current distribution bar comprises a first portion attached to the current supply device, a second portion extending along the electrode
(Continued)

substrate, and a third portion extending between the first and second portions. The current distribution bar is bent between its first and second ends, and the current supply device is laterally and longitudinally positioned beyond the electrode substrate. The second portion at least partly extends longitudinally along the electrode substrate.

20 Claims, 3 Drawing Sheets

(51) Int. Cl.

| | |
|---|---|
| ***C25B 9/17*** | (2021.01) |
| ***C25B 9/63*** | (2021.01) |
| ***C25B 9/65*** | (2021.01) |
| ***C25C 1/00*** | (2006.01) |
| ***C25C 7/02*** | (2006.01) |

ELECTRODE ASSEMBLY FOR ELECTROCHEMICAL PROCESSES

CROSS-REFERENCE TO RELATED APPLICATION

This Application is the National Stage filing under 35 U.S.C. § 371 of PCT Application Ser. No. PCT/EP2020/065324 filed on Jun. 3, 2020, which claims the benefit of European Patent Application No. 19177908.1 filed on Jun. 3, 2019. The disclosures of both applications are hereby incorporated herein by reference in their entireties.

FIELD OF THE INVENTION

The present invention relates to the field of electrodes, and more particularly to an electrode assembly for use in electrochemical processes.

BACKGROUND OF THE INVENTION

One example of electrochemical processes is electrowinning, in which metals can be recovered from solutions bearing the metal in ionic form. These processes take place in electrolytic cells comprising electrodes in the form of one or more cathodes and one or more anodes, arranged alternately, which are immersed in the solution. When a current is passed through the electrolytic cell, the desired metal is plated onto the cathode.

Another example of such electrochemical processes is the generation of chlorine by means of electrolytic cells, wherein the solution is a saline.

A typical electrode assembly, such as the electrode assembly shown in U.S. Pat. No. 8,038,855, for such an electrochemical process comprises a current supply bar, often referred to as a hanger bar, which is arranged to extend horizontally across the electrolytic cell. The electrode assembly further comprises current distribution bars attached at the current supply bar and extending vertically therefrom, onto which an electrochemically active electrode substrate is attached, for example by welding. The electrode substrate is often composed of a base structure and an electrochemically active coating applied to the base structure. The materials of the base structure and the coating, as well as that of the current distribution bars are adapted to the process in which the electrode assembly is used. The current distribution bars are composed of an electrically conducting material, for conducting current from the hanger bar to the electrode substrate. As an example, for an anode used in electrowinning, electrically conducting materials generally used are copper and aluminium. Due to the low resistance to e.g. corrosion of these materials, it is necessary to apply a cladding thereto of a metal which is chemically resistant to the electrolyte solution used. Typically for anodes, a titanium cladding, or a cladding of another valve metal is used. Valve metals are also often used for the base structure of the electrode substrate. These metals are known as film-forming metals having the property of rapidly forming a passivating oxide film when connected as an electrode in the electrolyte in which the electrode assembly is expected to operate, which protects the underlying metal from corrosion by the electrolyte.

Other alternatives for the current supply bar and current distribution bars are single solid metals, such as solid titanium, solid nickel, or solid iron.

WO2014/047689 discloses an electrode assembly having a conducting bar and a plate attached to the conducting bar.

The bar and the plate are made of stainless steel. The conducting bar is hollow, and a conducting member made of cupper is welded to the bar inside of it. The conducting bar extends along a top edge of the plate and, in one embodiment, is partly bent at its ends to enable more of the plate to be immersed in the electrolytic solution.

Considering sustainability issues, techniques are being developed for reusing the electrode assemblies by performing a restoration process. However, typically, the current supply bar is not protected from corrosion in the same way as the current distribution bars, which causes long term problems preventing such reuse.

SUMMARY OF THE INVENTION

It would be desired to provide an electrode assembly which is better adapted to restoration and reuse of the whole assembly.

To better address this concern, in a first aspect of the invention there is presented an electrode assembly for an electrochemical process comprising a current supply device, an elongated current distribution bar comprising first and second ends; and a sheet-shaped electrode substrate attached to the current distribution bar and having a longitudinal extension and a lateral extension. The current supply device is laterally and longitudinally positioned beyond the electrode substrate. The current distribution bar is bent between its first and second ends. The current distribution bar comprises a first portion attached to the current supply device, a second portion extending along the electrode substrate, and a third portion extending between the first and second portions. The second portion at least partly extends longitudinally along the electrode substrate. With this construction there is no longer any hanger bar above the electrolyte, but instead the current distribution bar is formed such that its first portion, where it is connected with the current supply device, reaches to the side of the electrolyte when the electrode substrate is immersed therein. The current distribution bar replaces the conventional hanger bar, and additionally extends longitudinally of the electrode substrate like a conventional current distribution bar to efficiently distribute current to the electrode substrate.

In accordance with an embodiment of the electrode assembly, the third portion at least partly extends in a direction away from a longitudinal centre line of the electrode substrate.

In accordance with an embodiment of the electrode assembly, the current supply device comprises at least one recessed hole, and the first portion of the current distribution bar is releasably received in the recessed hole. Thereby, a flexible attachment is provided, which enables a smooth mounting and demounting of the current distribution bar at the current supply device.

In accordance with an embodiment of the electrode assembly, the first portion of the current distribution bar is received in the recessed hole in a press fit engagement. Press fitting provides a fast attachment, a rigid retaining and a good releasability.

In accordance with an embodiment of the electrode assembly, the current supply device comprises two halves, which are releasably clamped about the first portion.

In accordance with an embodiment of the electrode assembly, the current distribution bar comprises a core and an outer layer, said core being completely covered by the outer layer.

In accordance with an embodiment of the electrode assembly, the outer layer comprises a cladding of a longitudinally extending surface of the core, and first and second end layers which cover transversal end surfaces of the core. Thereby, the core is completely enclosed by the cladding, also at the ends where it typically is exposed.

In accordance with an embodiment of the electrode assembly, it comprises several current supply devices.

In accordance with an embodiment of the electrode assembly, it comprises several current distribution bars.

In accordance with an embodiment of the electrode assembly, each current distribution bar is provided with an individual current supply. This can be obtained, for instance, by providing separate connection portions at the current supply device, one for each current distribution bar, or by providing one current supply device per current distribution bar.

In accordance with an embodiment of the electrode assembly, it comprises a support element arranged at the first portion of the current distribution bar, wherein the support element is arranged to support the electrode assembly when mounted at an electrolytic cell.

In accordance with an embodiment of the electrode assembly, the current supply device comprises a current cable terminal for individual current feed to the current supply device.

In accordance with an embodiment of the electrode assembly, it comprises two electrode substrates attached to the current distribution bar at opposite sides of the current distribution bar, such that a space is provided between the electrode substrates.

In accordance with an embodiment of the electrode assembly, the several current distribution bars comprise two current distribution bars arranged at opposite lateral edges of the electrode substrate.

In accordance with an embodiment of the electrode assembly, it comprises first and second current supply devices arranged at the opposite lateral edges of the electrode substrate, wherein one current distribution bar of said two current distribution bars is connected to the first current supply device, and the other current distribution bar of said two current distribution bars is connected to the second current supply device.

BRIEF DESCRIPTION OF THE DRAWINGS

The invention will now be described in more detail and with reference to the appended drawings in which.

DESCRIPTION OF EMBODIMENTS

Figure 1:
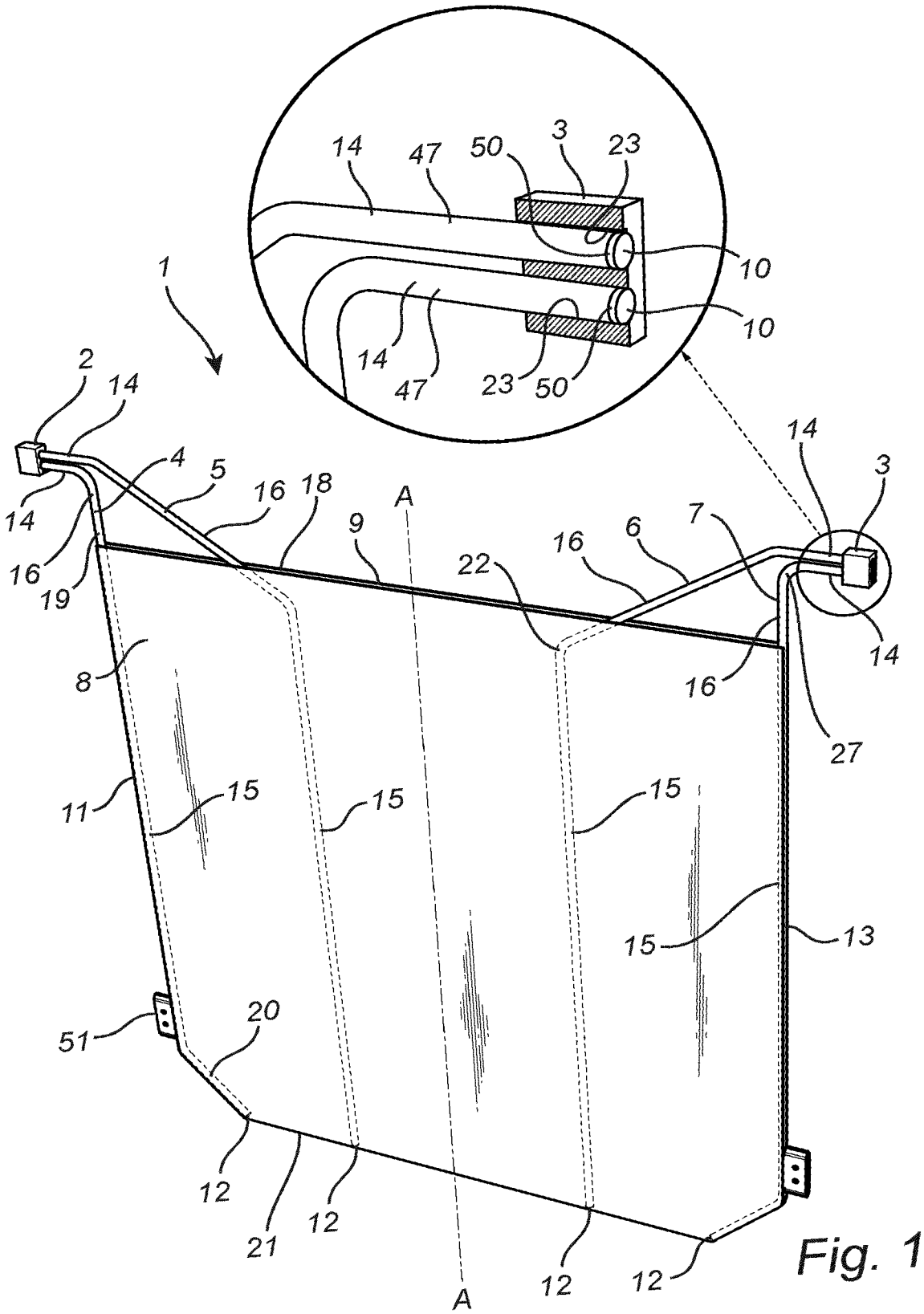
FIG. 1 is a perspective view of an embodiment of an electrode assembly according to the present invention.
Figure 4:
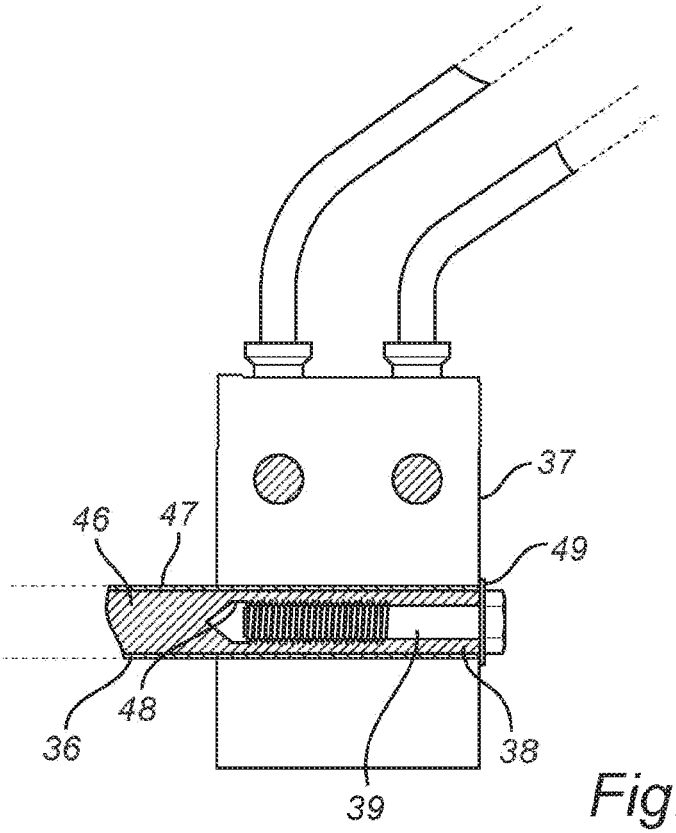
FIG. 4 is a cross-sectional view of a part of another embodiment of the electrode assembly according to the present invention.

With reference to FIG. 1, there is presented a first embodiment of an electrode assembly 1 for an electrochemical process, for use in an electrolytic cell. The electrode assembly 1 comprises two current supply devices 2, 3, four current distribution bars 4, 5, 6, 7 and two electrode substrates 8, 9. In a most simple embodiment the electrode assembly comprises only one current supply device, one current distribution bar and one electrode substrate, but generally several current distribution bars, and several current supply devices are provided. The present embodiment is a typical example. Each electrode substrate 8, 9 is sheet-shaped and has a longitudinal extension, which is vertical in a mounted orientation, as shown FIGS. 1 and 4, and a lateral extension, which is horizontal in the mounted orientation. Each electrode substrate 8, 9 has opposite first and second lateral edges 11, 13, a top edge 18, and an opposite bottom edge 21, wherein the edges are denoted in relation to a mounted orientation, i.e. when the electrode assembly 1 is mounted in an electrolytic cell, such as shown in FIG. 4. The current distribution bars 4-7 are arranged side by side at a distance from each other, and the electrode substrates 8, 9 are attached, e.g. by welding, to the current distribution bars 4-7 at opposite sides thereof, such that a space is provided between the electrode substrates 8, 9. The electrode substrates 8, 9 are arranged in parallel to each other. Since the electrode substrates 8, 9 are, thus, distanced by the thickness of the current distribution bars 4-7, the space is narrow. The current supply devices 2, 3 are arranged one at each lateral edge 11, 13 of the electrode substrates 8, 9, such that they are laterally and longitudinally positioned beyond the electrode substrates 8, 9. In other words, each current supply device 2, 3 has been laterally, or horizontally, as well as longitudinally, or vertically, displaced relative to the electrode substrates 8, 9 to a position above and to the side of the substrates 8, 9. First and second current distribution bars 4, 5 of the four current distribution bars 4-7 are connected with a first current supply device 2 of the current supply devices 2, 3, at one of the lateral edges 11, and third and fourth current distribution bars 6, 7 of the current distribution bars 4-7 are connected with a second current supply device 3 of the current supply devices 2, 3, at the other, opposite, lateral edge 13.

Each current distribution bar 4-7 is elongated and has a first end 10 and a second end 12, and is bent between its first and second ends 10, 12. However, in FIG. 1 only the first ends 10 of the third and fourth current distribution bars 6, 7 are shown and denoted. Further, each current distribution bar 4-7 has a first portion 14, which is located beyond the electrode substrates 8, 9 both laterally and longitudinally. In this embodiment, the first portion 14 includes the first end 10 of the current distribution bar 4-7. The first portion 14 is attached to the current supply device 2, 3. More particularly, the first ends of the first and second current distribution bars 4, 5 are attached to the first current supply device 2, and the first ends 10 of the third and fourth current distribution elements 6, 7 are attached to the second current supply device 3.

Each current distribution bar 4-7 comprises a second portion 15 extending along the electrode substrates 8, 9, i.e. in any direction along at least a part of the surface of the electrode substrates 8, 9, at or within the edges thereof. Typically, the second portion 15 extends at least partly, and typically at least substantially, longitudinally along the electrode substrates 8, 9, i.e. vertically in a mounted state. Furthermore, each current distribution bar 4-7 comprises a third portion 16 extending between the second portion 15 and the first portion 14. The third portion 16 at least partly extends in a direction away from a longitudinal centre line A-A of the electrode substrates 8, 9.

Thus, for instance, the second portion 15 of the first current distribution bar 4 extends along the first lateral edge 11 of the first electrode substrate 8. The second portion 15 of the first current distribution bar 4 turns into a protruding portion 19, included in the third portion 16, at the top edge 18 of the first electrode substrate 8. Thus, the protruding portion 19 protrudes longitudinally beyond the first and second electrode substrates 8, 9, out of the space between them. At the end of the protruding portion 19, the first distribution bar 4 makes a 90 degree turn, at least partly being included in the third portion 16, into the first portion 14, which extends laterally away from the electrode substrate 8, and thus from the longitudinal centre line A-A. The first portion 14 extends into the current supply device 2, where it is releasably attached. An end portion 20 of the first current distribution bar 4, at the second end 12 thereof, included in the second portion 15, extends obliquely towards the longitudinal centre line A-A and the bottom edge 21 of the first electrode substrate 8.

A major part of the second portion 15 of the second current distribution bar 5 extends longitudinally of the electrode substrates 8, 9, and in parallel with a corresponding part of the second portion 15 of the first current distribution bar 4, and it is laterally displaced towards the centre line A-A in relation thereto. However, at the second end 12 of the second current distribution bar 5, the second portion 15 continues straight all the way to the second end 12. Close to the top edge 18 of each electrode substrate 8, 9 the second current distribution bar 5 has been bent so that a portion of the second portion 15 extends at an angle to the major part of the second portion 15, away from the longitudinal centre line A-A of the substrates 8, 9. From the top edge 18, the third portion 16 of the second current distribution bar 5 continues in the same oblique direction, and after a further bend the third portion 16 turns into the first portion 14 extending laterally. More particularly, the second current distribution bar 5 extends straight from the bottom edge 21 towards the top edge 18, is bent at a minor distance from the top edge 18 of the first electrode substrate 8, extends obliquely away from the longitudinal centre line A-A, a portion of it protruding beyond the first and second electrode substrates 8, 9, is bent again and is finished by the first portion 14 which extends laterally, i.e. horizontally, into the first current supply device 2. The first portion 14 of the second current distribution bar 5 extends in parallel with the first portion 14 of the first current distribution bar 4, and is releasably connected with the first current supply device 2 too. It should be noted that, as understood by the person skilled in the art, there are many different ways of bending the current distribution bars, such as different number of bends, bends at other locations of the distribution bars, different bending angles, etc. However, the requirement of the current distribution bars is that they should extend to the side of and above the electrolyte when mounted in an electrolytic cell, such that the current supply devices are not positioned above the electrolyte.

The third and fourth current distribution bars 6, 7 are copies of the second and first current distribution bars 5, 4 respectively, mirrored in the longitudinal centre line A-A, and connected with the second current supply device 3. Thus, the fourth current distribution bar 7 is located at the second lateral edge 13 of the electrode substrates 8, 9, and the third current distribution bar 6 is located at a lateral distance from the fourth current distribution bar 7, between the second lateral edge 13 and the longitudinal centre line A-A. Consequently, the electrode assembly 1 comprises no detail that can be resembled with the conventional hanger bar in prior art electrode assemblies. In fact, there is no current supply bar feeding the current distribution bars above the electrode substrates 8, 9, i.e. straight above the electrolyte. The current supply devices 2, 3 are located aside of the electrolyte.

Each current supply device 2, 3 comprises at least one recessed hole 23, and in this embodiment of the electrode assembly 1 each current supply device 2, 3 comprises two recessed holes 23. The recessed holes 23 are through holes. However, in another embodiment, though not shown, the at least one recessed hole is not a through hole. The first portions 14 of the current distribution bars 4-7 have been releasably received in the recessed holes 23. Moreover, in this embodiment the first portions 14 are received in the recessed holes 23 in a press fit engagement, while still being releasable.

Furthermore, the electrode assembly 1 comprise two spacers 51, one at each lateral edge of the electrode assembly 1, at a lower region thereof. The spacers 51 are thicker than the pack of electrode substrates 8, 9, and ensure that when several electrode assemblies 1 are arranged in an electrolytic cell, they are properly spaced from each other.

Figure 2:
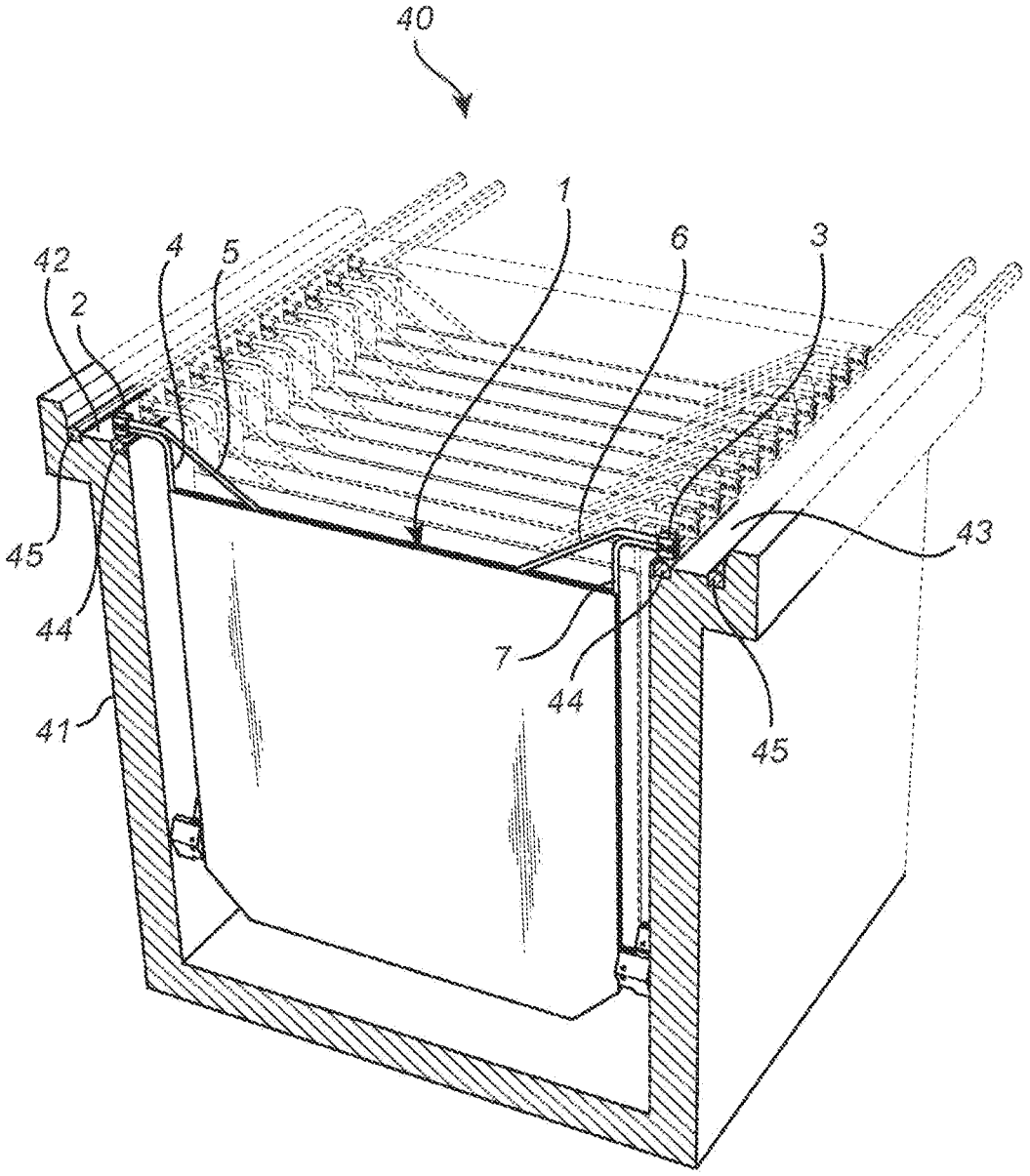
FIG. 2 is a cross-sectional view of an electrolytic cell comprising the electrode assembly shown in FIG. 1.

An electrolytic cell 40, as shown in FIG. 2, comprises a trough 41 containing an electrolyte, and several electrode assemblies 1, which have been immersed in the trough 41. Each electrode assembly 1 hangs on horizontal support surfaces 42, 43 provided at both sides of the mouth of the trough 41. More particularly, each support surface 42, 43 comprises two current rails 44, 45, an inner current rail 44 and an outer current rail 45, extending side by side along the support surface 42, 43, and slightly protruding above the surrounding portions of the support surface. The current supply devices 2, 3 of the electrode assembly 1 rest on one inner rail 44 each. The outer rails 45 are used by the other kind of electrode assemblies, not shown. Assume, for instance, that the shown electrode assembly 1 is an anode, then the cathodes rest on the outer current rails 45. The construction of the cathodes can be similar but also different, such as the conventional hanger bar-clad bar construction. The current distribution bars 4-7 are, thus, current fed via the current rails 44.

Figure 3:
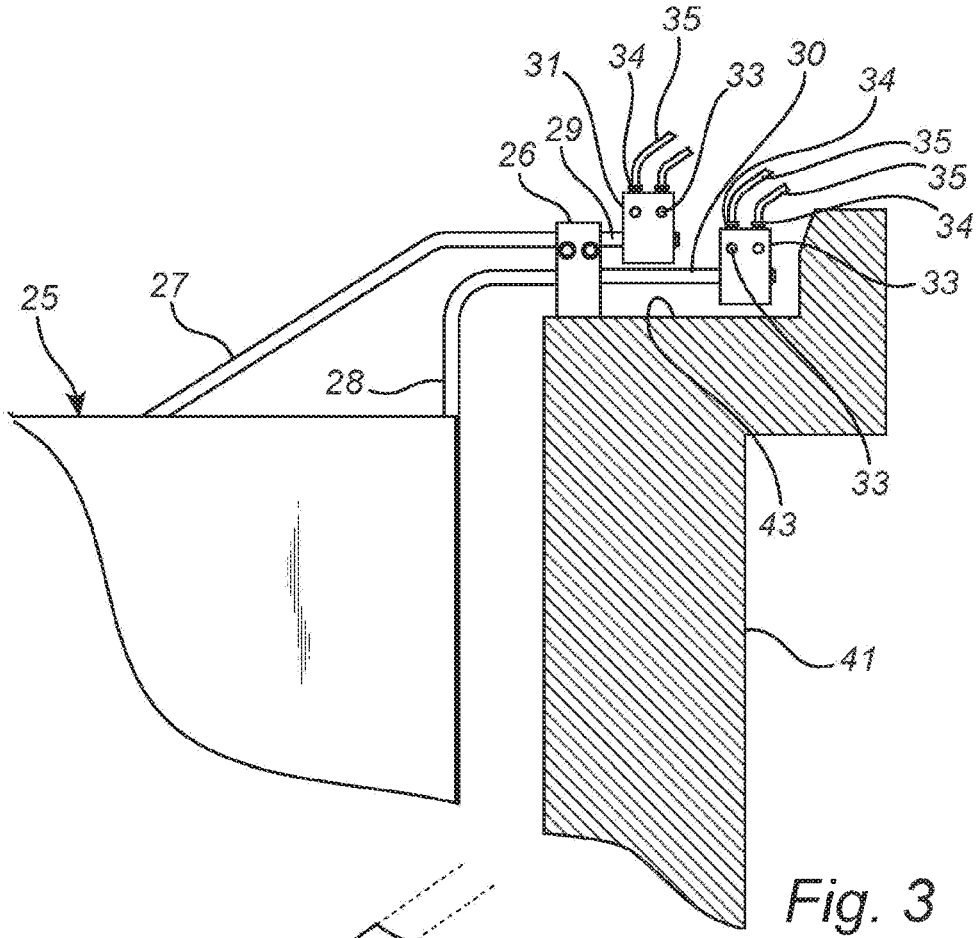
FIG. 3 is a cut-away view of a part of an electrolytic cell and another embodiment of the electrode assembly according to the present invention.

A second embodiment of the electrode assembly 25 resembles the first embodiment, except for the solution for the current supply devices and the hanging of the electrode assemblies in the trough 41, as shown in FIG. 3. The electrode assembly 25 comprises a support element 26, at each side of the electrode assembly, arranged at the first portions 29, 30 of the current distribution bars 27, 28. More particularly, each support element is block shaped and comprises two halves, which have been joined together around the current distribution bars 27, 28 at their first portions 29, 30, and fix the first portions 29, 30 to extend at a distance from each other. The support element 26 is made of a non-conducting material, such as plastic, thereby insulating the current distribution bars 27, 28 from each other, and it rests on the support surface 43 of the trough 41. Furthermore, the electrode assembly 25 comprises four current supply devices, one for each current distribution bar 4-7. However, only two current supply devices 31, 32 are shown in FIG. 3 since only one side of the electrode assembly 25 is shown. As understood this second embodiment of the electrode assembly 25 is symmetric, just like the first embodiment. Each current supply device 31, 32 is arranged close to the first end of the respective current distribution bar 27, 28, and between the support element 26 and the first end. Each current supply device 31, 32 is block shaped and made in two halves, which have been joined around the current distribution bar 27, 28. More particularly, the current distribution bar 27, 28 has been clamped between the halves, which in turn are joined by means of two screws 33. However, unlike in the first embodiment the current supply devices 31, 32 do not rest on the support surface 41 but there is a space in between. Rather than being current fed via the current rail at the support surface, each current supply device 31, 32 is provided with at least one, and in this embodiment two, current cable terminals 34, a respective current cable 35 being attached to each one of them. Thus, the electrode assembly 25 can be individually fed with current via the current cables 35 to the current cable terminal 34. As readily understood, each support element 26 can hold more as well as fewer than two current distribution bars, depending on the design of the electrode assembly 25 as a whole.

A third embodiment of the electrode assembly resembles the second embodiment, except for at the first ends of the current distribution bars 36, as shown in FIG. 4. In FIG. 4, showing a longitudinal cross-section of an end portion of one current distribution bar 36 and the current supply device 37, one half of which is thus shown. A longitudinal boring 48 extends a distance into the current distribution bar 36 from its first end 38 along its longitudinal axis. A cover screw 39 has been screwed into the boring. The cover screw has an integral washer 49 having a diameter exceeding the diameter of the current distribution bar 36.

In all above embodiments of the electrode assembly, but as particularly shown in FIG. 4, the current distribution bar 4-7, 27, 28, 36 is composed of a core 46 and an outer layer 47. The core 46 is made of an electrically conducting material, such as for example copper, aluminium and silver. Such materials are often reactive to the processing environment in which the electrode assembly 1, 25 is used, i.e. to the electrolyte solution of the electrolytic cell 40. The current distribution bar 36 therefore further comprises the outer layer 47 arranged to prevent the core 46 from chemically reacting with the processing environment, e.g. the electrolyte, which for example could cause severe corrosion of the core 46, and thus, lead to a short durability of the electrode assembly. The core 46 is here clad in the outer layer 47, which is chosen from materials which are inert in the processing environment. In an embodiment of an electrode assembly 1, 25 used as an anode, for example, the outer layer 47 is preferably selected from the group of valve metals, such as but not limited to titanium and tantalum. In a currently preferred embodiment, the outer layer 47 is made of titanium and the core 46 is made of copper.

In the first and second embodiments of the electrode assembly 1, 25, the outer layer 47 completely covers the core of the current distribution bar 4-7, 27, 28, including at end surfaces thereof, i.e. cladding caps 50, as best shown in FIG. 1, has been welded onto the corresponding end surface of the core 46. Such a cladding cap 50 preferably is of the same material as the rest of the cladding 47 of the current distribution bar 6, 7. The skilled person understands that an outer end layer may be provided in ways different from a cap welded to the end surfaces of the core. For example, outer end layers 9 may be fastened by fastening elements, by soldering, or by means of a conductive adhesive.

However, in the third embodiment, the cover screw 39 has been provided as an alternative to the cladding layer. The washer 49 of the screw is engaged with the very end surface of the outer layer 47 in a manner that secures a tight engagement, thereby preventing electrolyte from reaching the core material.

In the shown embodiments, each current supply device 2, 3, 31, 32, 37 has a rectangular cross-section. The cross-section of the current supply device may, however, be of any other suitable shape, such as for example square, circular, or elliptical. The current supply device 2, 3, 31, 32, 37 is preferably made of a conducting material, such as, but not limited to, copper, aluminium, silver and zinc. In a preferred embodiment, the current supply device 2, 3, 31, 32, 37 is made of copper.

While the invention has been illustrated and described in detail in the drawings and foregoing description, such illustration and description are to be considered illustrative or exemplary and not restrictive. The invention is not limited to the disclosed embodiments. The invention is generally applicable to any process using an electrode assembly comprising a current distribution bar with a core and an outer layer. Examples of such processes are electrowinning, electrogalvanizing, electroliberation, the chloralkali diaframgma process and processes using monopolar chlorate anodes.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

What is claimed is:

1. An electrode assembly for an electrochemical process comprising:

at least one current supply device;

at least two elongated continuous current distribution bars, each comprising integrated first and second ends; and a sheet-shaped electrode substrate attached to the at least two elongated continuous current distribution bars and having a longitudinal extension, which is vertical in a mounted orientation and a lateral extension, which is horizontal in the mounted orientation;

wherein each of the at least two elongated continuous current distribution bars comprises a first portion attached to the current supply device, a second portion extending along the electrode substrate, and a third portion extending between the first and second portions, wherein each of the at least two elongated continuous current distribution bars is bent between its first and second ends, wherein the second portion at least partly extends longitudinally along the electrode substrate, and wherein the current supply device is laterally and longitudinally positioned beyond the electrode substrate.

2. The electrode assembly according to claim 1, wherein the third portion at least partly extends in a direction away from a longitudinal centre line (A-A) of the electrode substrate.

3. The electrode assembly according to claim 1, wherein the current supply device comprises at least one recessed hole, wherein the first portion of an elongated continuous current distribution bar of the at least two elongated continuous current distribution bars is releasably received in the at least one recessed hole.

4. The electrode assembly according to claim 3, wherein the first portion is received in the at least one recessed hole in a press fit engagement.

5. The electrode assembly according to claim 1, wherein the current supply device comprises two halves, which are releasably clamped about the first portion.

6. The electrode assembly according to claim 1, wherein each of the at least two elongated continuous current distribution bars comprises a core and an outer layer, said core being completely covered by the outer layer.

7. The electrode assembly according to claim 6, wherein the outer layer comprises a cladding of a longitudinally extending surface of the core, and first and second end layers which cover transversal end surfaces of the core.

8. The electrode assembly according to claim 1, further comprising a plurality of current supply devices.

9. The electrode assembly according to claim 1, further comprising more than two elongated continuous current distribution bars.

10. The electrode assembly according to claim 8, wherein each of the at least two elongated continuous current distribution bars is provided with an individual current supply.

11. The electrode assembly according to claim 1, comprising a support element arranged at the first portion of an elongated continuous current distribution bar of the at least two elongated continuous current distribution bars, wherein the support element is arranged to support the electrode assembly when mounted at an electrolytic cell.

12. The electrode assembly according to claim 11, wherein the current supply device comprises a current cable terminal for individual current feed to the current supply device.

13. The electrode assembly according to claim 1, comprising two electrode substrates attached to the at least two elongated continuous current distribution bars at opposite sides of the at least two elongated continuous current distribution bars, such that a space is provided between the electrode substrates.

14. The electrode assembly according to claim 1, wherein the at least two elongated continuous current distribution bars are arranged at opposite lateral edges of the electrode substrate.

15. The electrode assembly according to claim 14, further comprising first and second current supply devices arranged at the opposite lateral edges of the electrode substrate, wherein one elongated continuous current distribution bar of said at least two elongated continuous current distribution bars is connected to the first current supply device, and the other elongated continuous current distribution bar of said at least two elongated continuous current distribution bars is connected to the second current supply device.

16. The electrode assembly according to claim 2, wherein the current supply device comprises at least one recessed hole, wherein the first portion of an elongated continuous current distribution bar of the at least two elongated continuous current distribution bars is releasably received in the recessed hole.

17. The electrode assembly according to claim 2, wherein the current supply device comprises two halves, which are releasably clamped about the first portion.

18. The electrode assembly according to claim 3, wherein the current supply device comprises two halves, which are releasably clamped about the first portion.

19. The electrode assembly according to claim 3, wherein each of the at least two elongated continuous current distribution bars comprises a core and an outer layer, said core being completely covered by the outer layer.

20. An electrolytic cell comprising an electrode assembly for an electrochemical process comprising:

at least one current supply device;

at least two elongated continuous current distribution bars, each comprising integrated first and second ends; and a sheet-shaped electrode substrate attached to the at least two elongated continuous current distribution bars and having a longitudinal extension, which is vertical in a mounted orientation and a lateral extension, which is horizontal in the mounted orientation;

wherein each of the at least two of elongated continuous current distribution bars comprises a first portion attached to the current supply device, a second portion extending along the electrode substrate, and a third portion extending between the first and second portions, wherein each of the at least two elongated continuous current distribution bars is bent between its first and second ends, wherein the second portion at least partly extends longitudinally along the electrode substrate, and wherein the current supply device is laterally and longitudinally positioned beyond the electrode substrate.

* * * * *